US005269083A

United States Patent [19]

Vampatella et al.

[11] Patent Number: 5,269,083

[45] Date of Patent: Dec. 14, 1993

[54] QUICK CHANGE PICTURE FRAME APPARATUS

[76] Inventors: Claudia Vampatella; Bennie Vampatella, both of 6459 Shawnee Ave., Las Vegas, Nev. 89107

[21] Appl. No.: 964,809

[22] Filed: Oct. 22, 1992

[51] Int. Cl.[5] ..... G09F 7/04

[52] U.S. Cl. ..... 40/124.1; 40/621; 248/467; 248/206.5

[58] Field of Search ..... 40/152, 621, 600, 657; 248/467, 206

[56] References Cited

U.S. PATENT DOCUMENTS 2,748,498 6/1956 Stuart et al. ..... 40/621
4,040,194 8/1977 Penton et al. ..... 40/621
4,100,684 7/1978 Berger ..... 248/206.5
4,531,320 7/1985 James ..... 40/621
4,817,320 4/1989 Fraynd ..... 40/621

*Primary Examiner*—Kenneth J. Dorner
*Assistant Examiner*—C. Hope Davis
*Attorney, Agent, or Firm*—Henderson & Sturm

[57] ABSTRACT

A quick change multi-picture frame apparatus (10) for receiving a plurality of subframes (100) having magnetic members (103) provided on their back surfaces; wherein, the apparatus (10) includes a multi-compartmented mainframe (20) having a magnetically attractive element (13) provided in each of the compartments (12) for releasably receiving the subframes (100).

1 Claim, 1 Drawing Sheet

QUICK CHANGE PICTURE FRAME APPARATUS

TECHNICAL FIELD

The present invention relates to the field of picture frames in general, and in particular to a compartmented frame arrangement having means for receiving a plurality of interchangeable sub-frame assemblies.

BACKGROUND ART

This invention was the subject matter of Document Disclosure Program Registration No. 300,420 which was filed in the United States Patent and Trademark Office on Jan. 31, 1992.

As can be seen by reference to the following U.S. Pat. Nos. 4,779,368; 4,608,770; 5,020,251; and 4,553,344; the prior art is replete with myriad and diverse multi-frame picture display arrangements.

While all of the aforementioned prior art constructions are more than adequate for the basic purpose and function for which they have been specifically designed, these patented structures are uniformly deficient with regard to the ease in which a subframe is inserted into and removed from the main frame.

In addition virtually all of the prior art constructions require that a customized sub-frame be provided to accommodate the particular requirements of the mainframe structure.

As a consequence of the foregoing situation, there has existed a longstanding need among consumers for a mainframe construction that is specifically designed to accommodate popular commercially available magnetic picture frames as the subframe elements which may be quickly and simply inserted and removed from the mainframe; and, the provision of such a construction is a stated objective of the present invention.

DISCLOSURE OF THE INVENTION

Briefly stated, the quick change picture frame apparatus that forms the basis of the present invention comprises in general a multi-compartmented mainframe unit that is dimensioned to receive a plurality of standard size photographs mounted in commercially available clear acrylic frames having a magnet attached on the back of the frames.

In addition each of the compartments of the mainframe are provided with magnetically attractive plate members that will magnetically retain the subframes within the compartments of the mainframe in a well recognized manner.

As will be explained in greater detail further on in the specification, the mainframe plate members not only form a magnetically attractive surface for the subframe magnets to adhere; but they also provide a rocking fulcrum point to facilitate the removal of the individual subframes relative to the mainframe.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
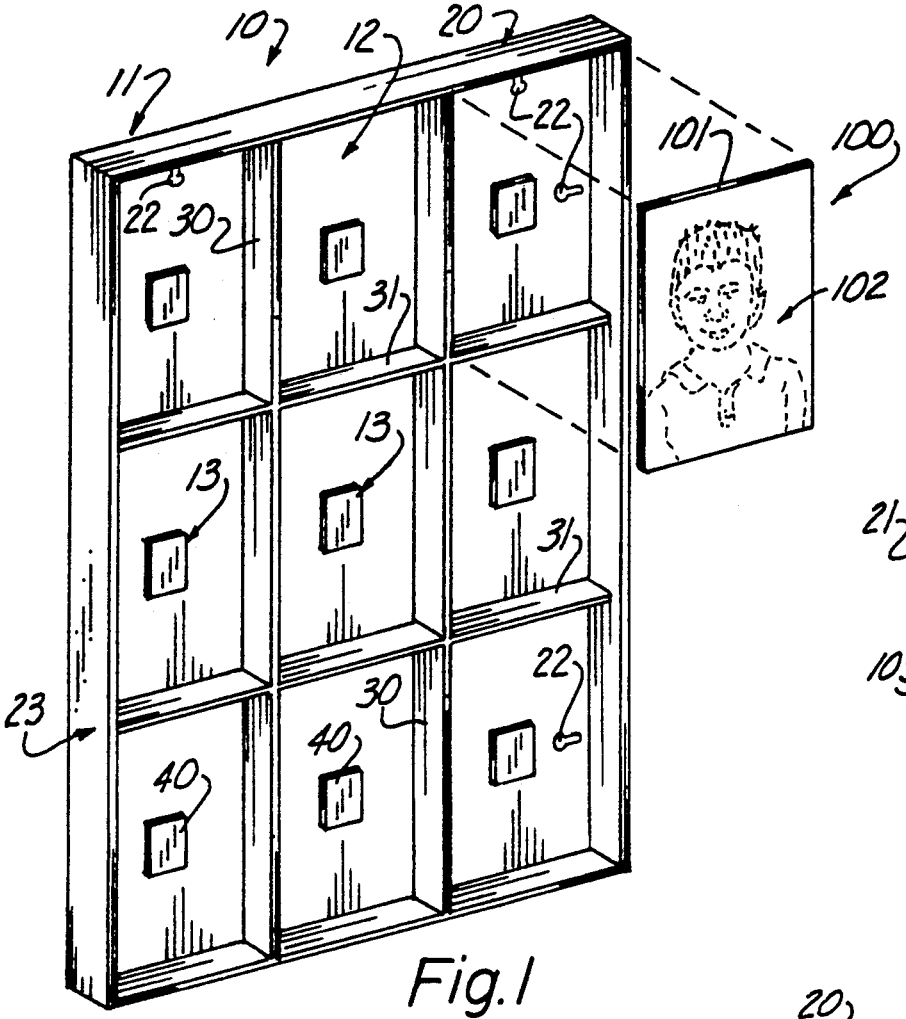
FIG. 1 is a perspective view of the quick change picture frame apparatus that forms the basis of the present invention.

As can be seen by reference to the drawings, and in particular to FIG. 1, the quick change picture frame apparatus that forms the basis of the present invention is designated generally by the reference numeral (10). The apparatus (10) comprises in general a mainframe unit (11) having a plurality of compartments (12); wherein, each compartments (12) is provided with a magnetically attractive element (13) whose purpose and function will be described presently.

Prior to embarking on a detailed explanation of the apparatus (10), it would first be advisable to describe the commercially available subframe (100) that is intended to be employed in this apparatus (10).

Figure 3:
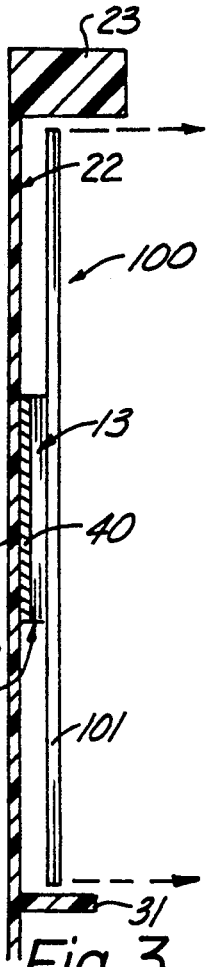
FIG. 3 is a cross-sectional view taken through line 3—3 of FIG. 2; and, FIG. 4 is a rear perspective view of the frame apparatus.

As can best be seen by reference to FIGS. 1 and 3, the subframe (100) comprises a clear acrylic frame (101) provided with a slot (not shown) for receiving a standard sized photograph (102); wherein, the back of the acrylic frame (101) is provided with a magnetic member (103) for attaching the acrylic frame (101) to a magnetically attractive surface, such as a refrigerator, or the like.

Figure 2:
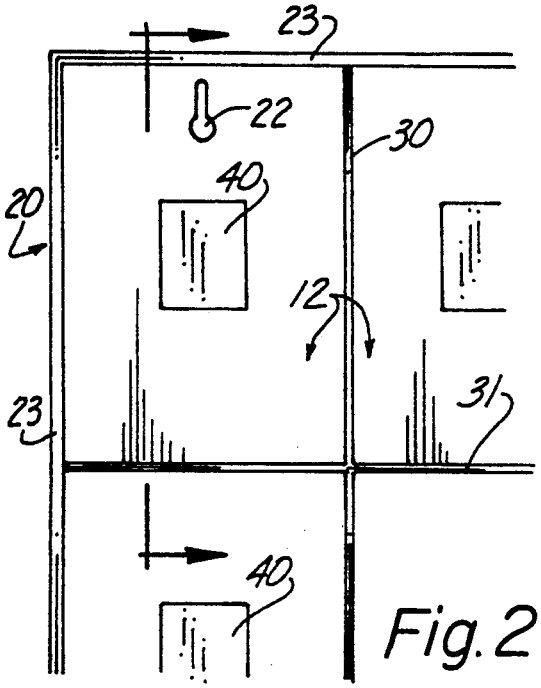
FIG. 2 is an isolated front plan view of the portion of the frame apparatus.
Figure 4:
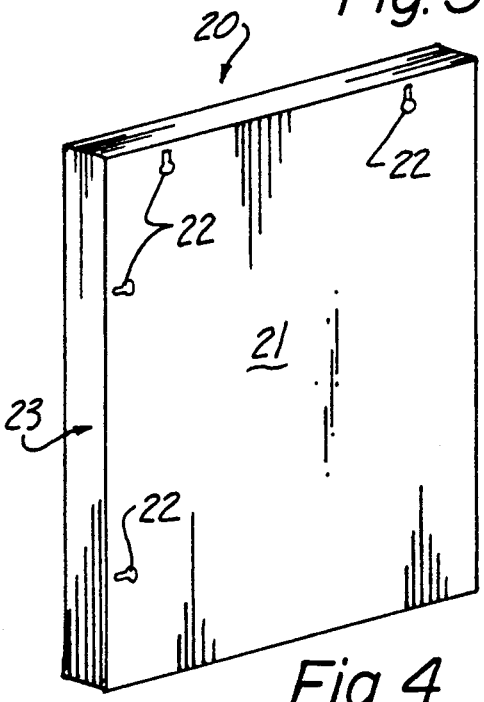

As shown in FIGS. 1, 2 and 4, the mainframe unit (11) comprises a generally rectangular mainframe member (20) having a back panel (21) provided with a plurality of mounting apertures (22) disposed along two adjacent sides of the back panel (21). In addition the periphery of the back panel is provided with raised sidewalls (23) to form a shallow open boy type configuration.

As can best be seen by reference to FIGS. 1 and 2, each of the compartments (12) within the mainframe member (20) is created by a plurality of divider panels (30) (31) arranged perpendicular to one another, in a well recognized fashion, within the interior space defined by the raised sidewalls (23) of the mainframe member (30).

Turning now to FIGS. 1 through 3, it can be seen that each of the magnetically attractive elements (13) comprise a magnetically attractive metal plate (40) centrally disposed within each of the compartments (12); wherein the metal plates (40) are intended to form a magnetically attractive surface to which the magnets (103) on the back of the subframes (100) will adhere.

In addition, as can be seen particularly by reference to FIG. 3, the combined thickness of both the metal plate (40) and the magnet (103) represents the total distance that one edge of the subframe may be depressed to pivot the subframe magnet (103) away from the opposite edge of the metal plate (40) to break the magnetic attraction between the metal plate (40) and magnet (103) in the process of removing the subframe (100) from one of the compartments (12) in the mainframe (20).

In this manner the metal plate (40) acts as a moveable fulcrum depending upon which edge of the subframe (100) is depressed towards the back panel (21) of the mainframe (20) to effect the removal of the subframe (100).

Furthermore as shown in FIG. 4, the mounting holes (22) are provided in adjacent edges of the back panel

(21) so that the mainframe (20) may be selectively oriented in either the vertical or horizontal plane.

It should also be noted at this juncture that while the mainframe and the compartments formed therein have been described as having a generally rectangular configuration; other geometric configurations could be substituted therefore in keeping with the teachings of this invention.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A multi-picture frame apparatus consisting of:

a plurality of generally rectangular subframes having a front and back wherein the back of each of the subframes is provided with a relatively small, outwardly projecting, and generally centrally disposed magnetic member:

a mainframe unit, including a back panel having a front surface and a back surface, and raised sidewalls;

a plurality of divider panels operatively associated with the mainframe unit to create a plurality of generally rectangular compartments within the area defined by the raised sidewalls; wherein, each of the compartments are dimensioned to receive one of said subframes; and a magnetically attractive element disposed in each of the compartments for releasably engaging the magnetic members on the back of each of said plurality of subframes; wherein, each of said magnetically attractive elements comprise a generally small, outwardly projecting metal plate, centrally disposed within each of said compartments and spaced from the divider panels that define each of said compartments; wherein, when the magnetic members on said subframes and said metal plates are operatively engaged to one another the front of each subframe is disposed in a recessed relationship relative to said raised walls and the back of each subframe is spaced from the front surface of said back panel at a given distance equal to the combined thickness of the magnetic member and the associated outwardly projecting metal plate, and wherein, the physical connections between the magnetic members on said subframes and said metal plates may be substantially broken by forcing the periphery of the subframe into contact with the back panel of said mainframe unit to pivot one edge of the magnetic member away from engagement with one edge of the metal plate.

* * * * *